US010690361B2

(12) United States Patent
Allen

(10) Patent No.: US 10,690,361 B2
(45) **Date of Patent: *Jun. 23, 2020**

(54) VENTILATED LOCKER

(71) Applicant: Sam Allen, Maypearl, TX (US)

(72) Inventor: Sam Allen, Maypearl, TX (US)

( * ) Notice: Subject to any disclaimer, the term of this patent is extended or adjusted under 35 U.S.C. 154(b) by 249 days.

This patent is subject to a terminal disclaimer.

(21) Appl. No.: 15/897,875

(22) Filed: Feb. 15, 2018

(65) Prior Publication Data

US 2018/0172301 A1 Jun. 21, 2018

Related U.S. Application Data

(63) Continuation-in-part of application No. 15/832,073, filed on Dec. 5, 2017.

(51) Int. Cl.

| | |
|---|---|
| ***F26B 25/06*** | (2006.01) |
| ***F24F 7/08*** | (2006.01) |
| ***A47B 61/00*** | (2006.01) |
| *A47F 3/00* | (2006.01) |

(52) U.S. Cl.

CPC ..... *F24F 7/08* (2013.01); *A47B 61/00* (2013.01); *A47F 3/001* (2013.01)

(58) Field of Classification Search

CPC .... F26B 9/00; F24F 7/08; A47B 61/00; A47F 3/001

USPC ..... 34/235, 210, 201, 202, 209, 212

See application file for complete search history.

(56) References Cited

U.S. PATENT DOCUMENTS

| | | | | |
|---|---|---|---|---|
| 4,384,191 | A * | 5/1983 | Guibert | A23L 3/365 126/110 A |
| 5,369,892 | A * | 12/1994 | Dhaemers | D06F 58/10 34/224 |
| 6,868,621 | B1 * | 3/2005 | Grimm | D06F 58/10 34/104 |
| 8,496,308 | B2 * | 7/2013 | Zabbatino | G06Q 30/0645 312/404 |
| 9,968,807 | B2 * | 5/2018 | Squicciarini | A62B 15/00 |
| 2005/0278972 | A1 * | 12/2005 | Maruca | D06F 58/10 34/201 |
| 2011/0074256 | A1 * | 3/2011 | Boice | A47B 81/00 312/213 |
| 2013/0199581 | A1 * | 8/2013 | Christopherson | B08B 5/026 134/103.2 |

OTHER PUBLICATIONS

SchoolLockers.com. Football Equipment Lockers, Feb. 28, 2015, SchoolLockers.com, p. 2 (Year: 2015).

(Continued)

*Primary Examiner* — John P McCormack

(74) *Attorney, Agent, or Firm* — James E. Walton

(57) ABSTRACT

A ventilated locker includes a pair of sidewalls and a back wall connecting the sidewalls. A plurality of compartments is defined between the sidewalls, including at least an upper compartment and a lower compartment. A plenum is disposed adjacent the back wall, the plenum configured for connection to an existing HVAC system. At least one ventilation grille is carried by the back wall in fluid communication with at least one one of the plurality of compartments and with the plenum. At least one circulation fan is disposed in one of the plurality of compartments to circulate air from the ventilation grilles through the plurality of compartments.

24 Claims, 6 Drawing Sheets

(56) References Cited

OTHER PUBLICATIONS

Office Action dated Jun. 10, 2019 in related U.S. Appl. No. 15/832,073.
Response to Office Action dated Jun. 10, 2019 in related U.S. Appl. No. 15/832,073.

* cited by examiner

VENTILATED LOCKER

This application is a continuation-in-part of U.S. application Ser. No. 15/832,073, filed 5 Dec. 2017, titled "Ventilated Locker," which is incorporated herein by reference for all purposes.

BACKGROUND

1. Field of the Invention

The present invention relates generally to improvements in lockers or storage cabinets used in athletic or sporting facilities, and more specifically to ventilation of such lockers.

2. Description of Related Art

The aesthetics and utility of lockers or storage cabinets in "locker rooms" of athletic and sporting facilities of sports teams and country clubs, for example, have become a measure of the quality and prestige of such organizations and an increasingly important aspect of recruiting new team or club members. Modern lockers are a far cry from the simple wood or metal cabinets of the past.

Modern lockers may incorporate storage for specific items of equipment, such as helmets and shoes, and features promoting comfort and luxury. One consistent problem in locker rooms of all types is the storage of heavy, cumbersome equipment such as football, lacrosse, or hockey helmets and pads. Many current locker designs lack adequate ventilation. As a result, the contents of the locker, if and when stored damp, are subject to bacterial and fungal growth, resulting in discoloration and bad odors.

There is a constant need for improvement in these and other aspects of such lockers.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 2A:
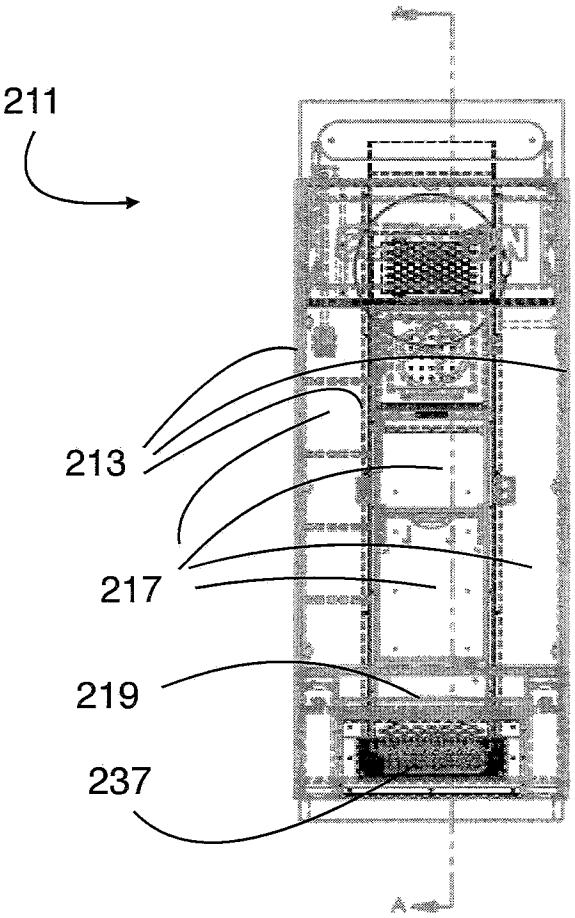
FIGS. 2A through 2C are front, back, and side elevation views, partially in section, of a locker incorporating the equipment storage fixture or rack according to another embodiment of the present application.
Figure 1A:
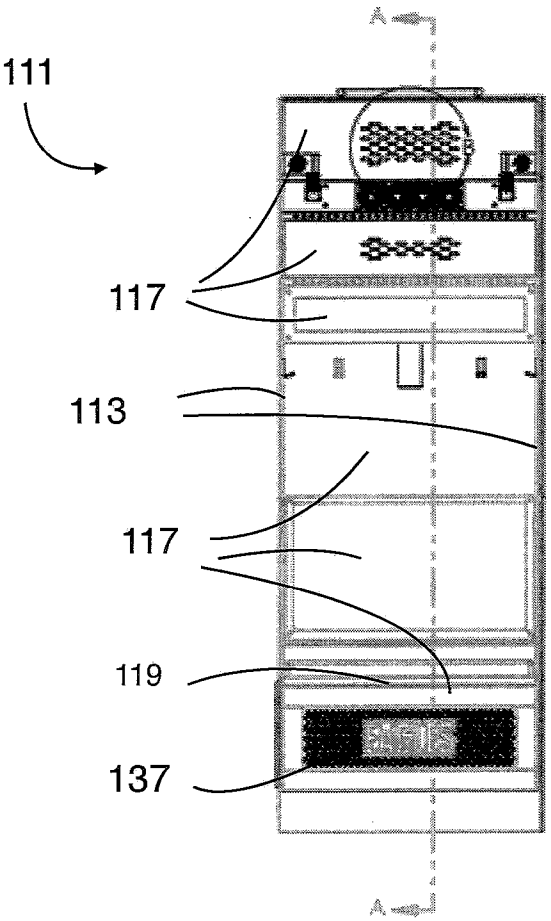
FIGS. 1A through 1D are front, back, and side elevation views, and a perspective view, partially in section, of a locker incorporating the equipment storage fixture or rack according to the present application.

While the assembly and method of the present application is susceptible to various modifications and alternative forms, specific embodiments thereof have been shown by way of example in the drawings and are herein described in detail. It should be understood, however, that the description herein of specific embodiments is not intended to limit the application to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the locker according to the present application are provided below. It will of course be appreciated that in the development of any actual embodiment, numerous implementation-specific decisions will be made to achieve the developer's specific goals, such as compliance with assembly-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Referring now to FIGS. 1A through 1C and 2A through 2C in the drawings, two embodiments of lockers 111, 211 according to the present application are depicted. Locker 111, 211 generally comprises a pair of upstanding sidewalls 113, 213 that generally define the extent of the locker. A back wall 115, 215 connects sidewalls 113, 213 at the rear of each locker 111, 211. Each locker 111, 211 may be installed adjacent to another, similar or identical locker, with its rear against a wall, and its front facing the interior of the locker room.

Figure 2B:
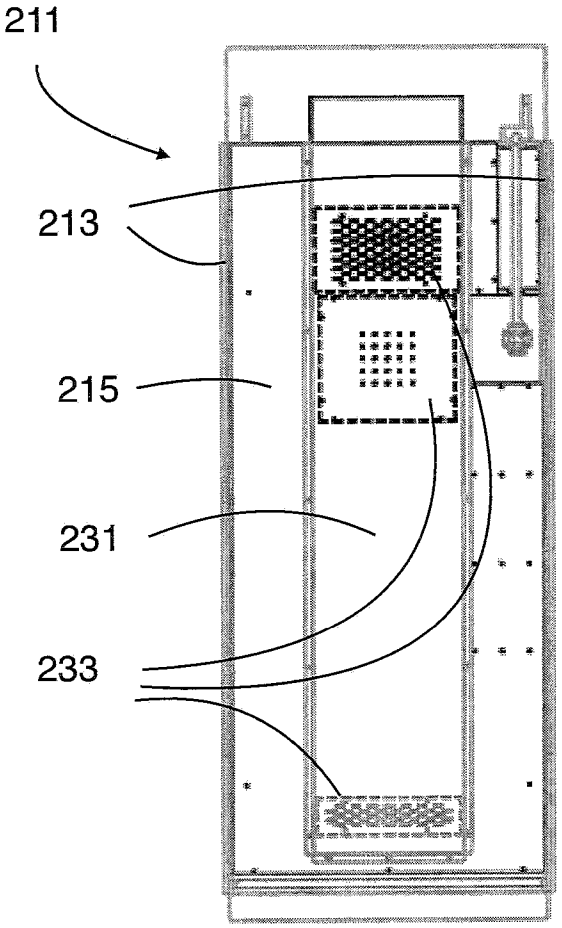
Figure 1B:
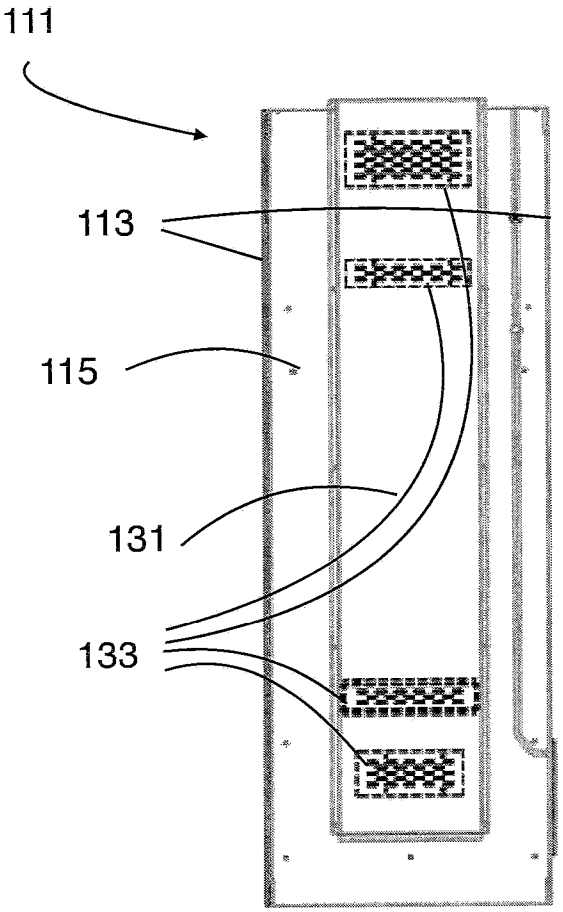
Figure 2C:
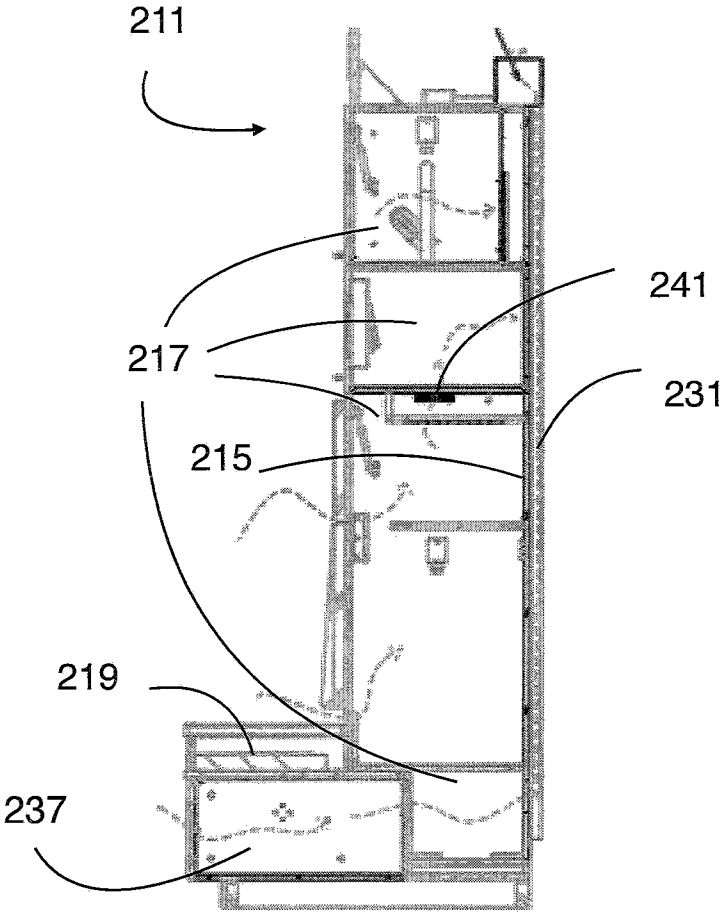
Figure 1C:
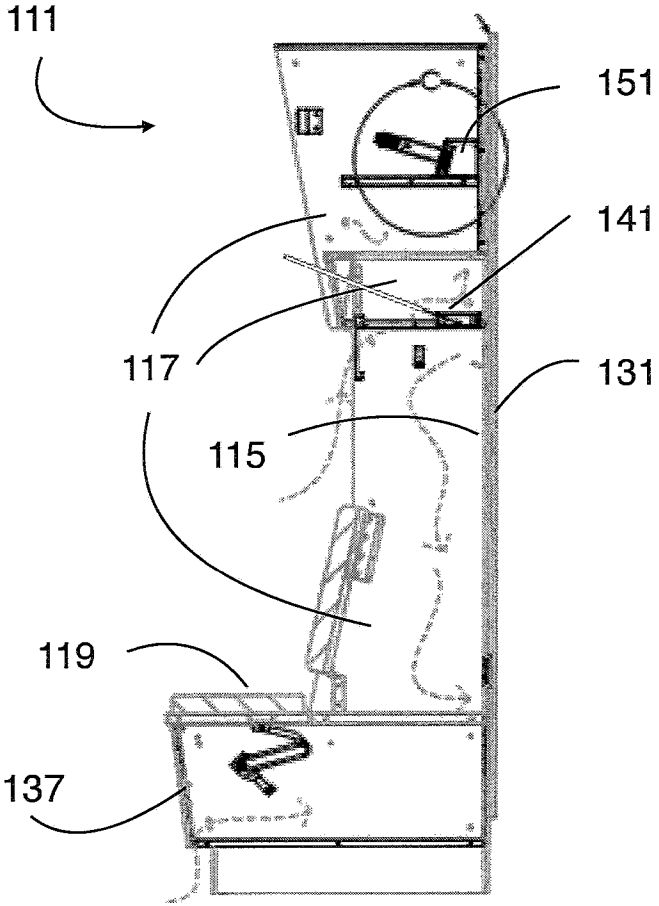

Between the sidewalls 113, 213 of locker 111, 211, a plurality of compartments 117, 217 are defined by shelves or other horizontally extending surfaces or platforms. As used herein, "sidewall" or "sidewalls" may refer to either "main" sidewalls 113, 213 or other upstanding or generally vertical sidewalls arranged between the "main" sidewalls. Multiple additional sidewalls 113, 213 may be placed between the "main" or exterior sidewalls 113, 213 to define compartments 117, 217 in cooperation with generally horizontally extending shelves or platforms. Vertical and horizontal walls between main sidewalls 113, 213 may also be referred to as "dividers" or "divider walls." Each compartment 117, 217 may be sized and otherwise configured for storage of clothing or sporting equipment or other items and may include at least one door, which may be lockable. Locker 111, 211 may also be provided with a bench seat 119, 219 or similar seating arrangement on top of a lowermost compartment, which may be divided into forward and rear compartments by a divider wall (FIG. 2C).

A plenum 131, 231 may be mounted on the rear or exterior side of back wall 115, 215. Plenum 131, 231 may be connected via duct work (not shown) to the existing HVAC of the locker room or room in which locker 111, 211 is disposed or situated. The HVAC system to which plenum 131, 133 is connected may be the conventional heating and cooling system of the building or room in which locker 111, 211 is disposed, or may be a dedicated system for the lockers themselves. The HVAC system thus provides or removes heated, cooled, and/or dehumidified air to each locker 111, 211, through plenum 131, 231. Plenum may deliver or remove air from locker 111, 211.

Plenum 131, 231 may communicate air from the HVAC system to the interior and various compartments 117, 217 of locker 111, 211, through a plurality of ventilation apertures or grilles 133, 233 formed in back wall 115, 215 of locker 111, 211. Preferably, a grille or aperture 133, 233 (grille is used herein to mean a single aperture or a group of apertures in any arrangement, e.g. circles, squares, other shapes, arranged in any pattern) is arranged through back wall 115, 215 at at least an upper extent and a lower extent (near the top and near the bottom) of locker 111, 211 to insure a supply of air to the entirety of the locker or at least the upper and lower compartments thereof.

Grilles 133, 233 may preferably be provided with a damper arrangement or mechanism that permits the partial closure or obstruction of the aperture(s) of grilles 133, 233 to control the flow of air from plenum 131, 231. One or more front or forward ventilation grilles 137, 217 may be provided in the front panels or surfaces (forward of back wall 115, 215 and generally between side walls 113, 213) of locker 111, 211 to permit exhaust or intake of air from or to the locker. Alternatively the natural gaps left between doors and openings in locker 111, 211 can provide the exhaust or intake of air. Grilles 133, 233 and their dampers may be controlled (opened or closed, fully or partially) manually or automatically, as by a programmed computer. Automatically controlled grilles may operate on a "schedule" (e.g. open or closed at night or during daylight hours) or according to airflow or other parameters, such as relative humidity in the locker room and the like.

Thus, airflow may be established (either vacuum/suction or positive pressure) through locker 111, 211 from plenum 131, 231, through ventilation grille 133, 233, and exits (or enters in the case of suction) locker 111, 211 through ventilation grille 137, 237 or other openings in the front or forward portions of locker. Alternatively, air circulated through the locker may be exhausted through a duct or conduit to an area remote from lockers 111, 211 and/or the locker room or building in which they are located. This circulation may be assisted by one or more circulation fans 141, 241. Circulation fan 141, 241 may be mounted to the upper or lower surface of a shelf, as illustrated, and the shelf may be provided with flow apertures so that fan 141, 241 can circulate air between the compartments separated by the shelf to insure circulation through the entirety of locker 111, 211. In the embodiment of FIGS. 2A through 2C, for example, fan 241 is mounted under a shelf that forms a helmet storage compartment. Vent holes or apertures in the shelf permit circulation of air from fan 241 up into the helmet resting on the shelf. A preferred fan 141, 241 is an Arctic F12 Silent 120 mm fan available from ARCTIC GmbH, Fasanenkamp 12, 38108 Braunschweig, Germany.

Figure 3:
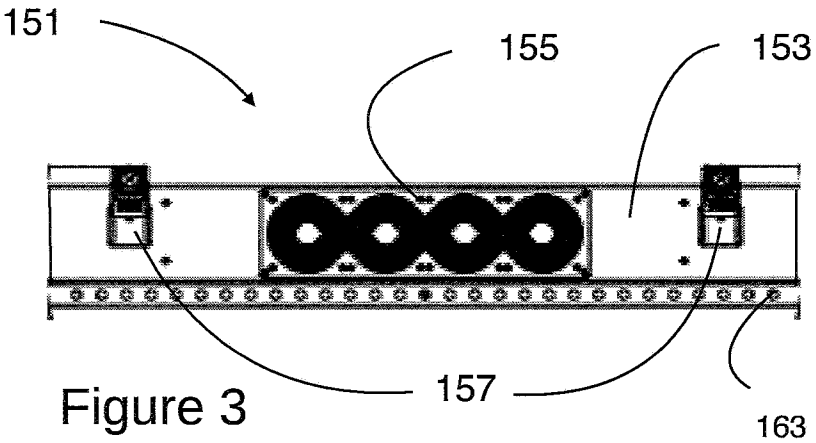
FIGS. 3 and 4 are enlarged front and side views of an equipment drying fixture illustrated in the embodiment of FIGS. 1A through 1D.
Figure 4:
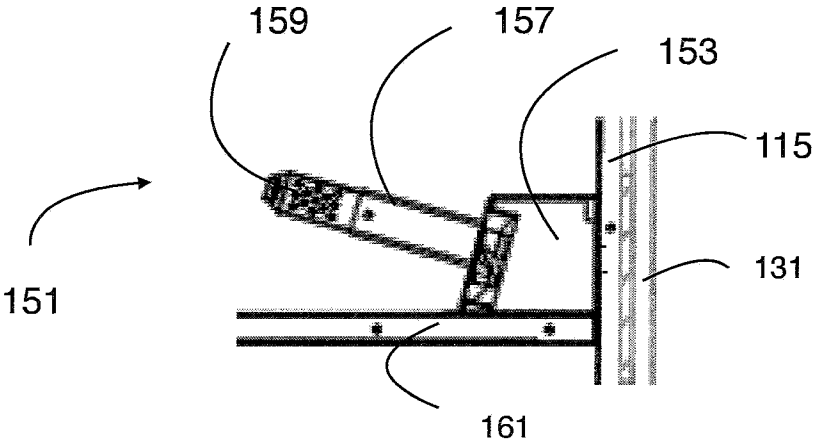
Figure 1D:
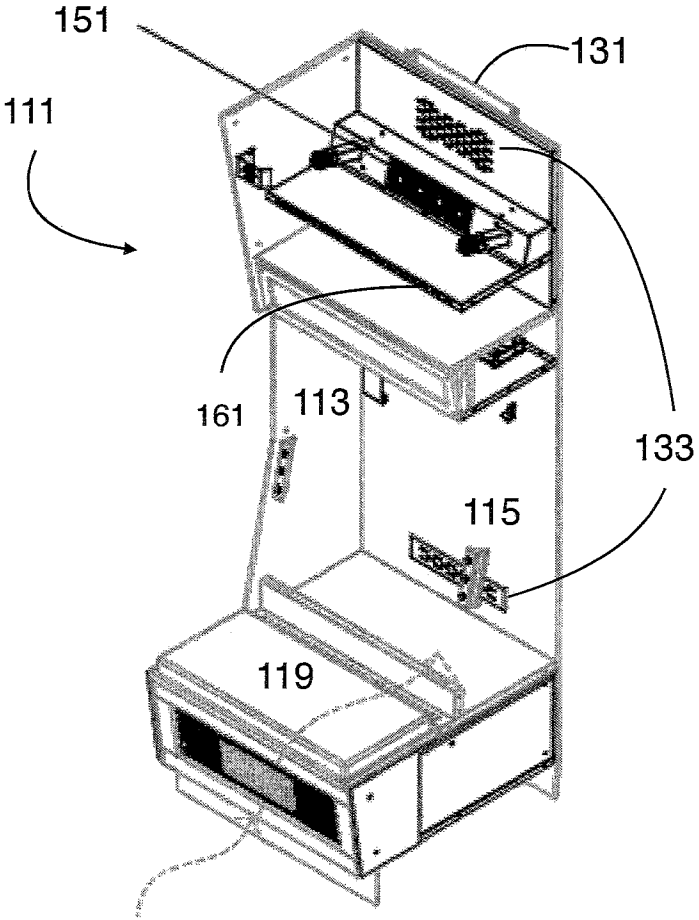

In addition to or as an alternative to circulation fans 141, 241, equipment-drying fixtures, such as glove and equipment dryer 151, may be provided in one or more compartments. As shown in detail FIGS. 3 and 4, fixture 151 comprises a generally rectangular manifold or plenum 153, that sits at the rear of a shelf 161 adjacent back wall 115 of locker 111. At least one and preferably four fans 155 may be carried by manifold 153 at approximately the midpoint thereof to provide intense air circulation in the central portion of the compartment. A pair of hollow, tubular projections 157 are outboard of fans 155 on either side and in fluid communication with manifold 153. Another fan 159 is carried in a perforated housing at the distal end of each projection 157 to increase air circulation at the distal end of each projection 157. Projections 157 are adapted to be received in the interior of and to support relatively small equipment such as gloves, or even shoes or socks, for drying thereof.

Manifold 153 is connected to plenum 131 through flow apertures in back wall 115 and thus draws air from the HVAC system. It also draws "ambient" air through shelf 161, which is hollow and features intake apertures 163 at its front edge. Fans 155 may preferably be model QFRO812SH-F00 from Delta Products Corporation, 46101 Fremont Blvd, Fremont, Calif. 94538. Fans 159 may preferably be ASB0412VHA-AF00, also from Delta Products Corporation.

Figures 5A, 5B:
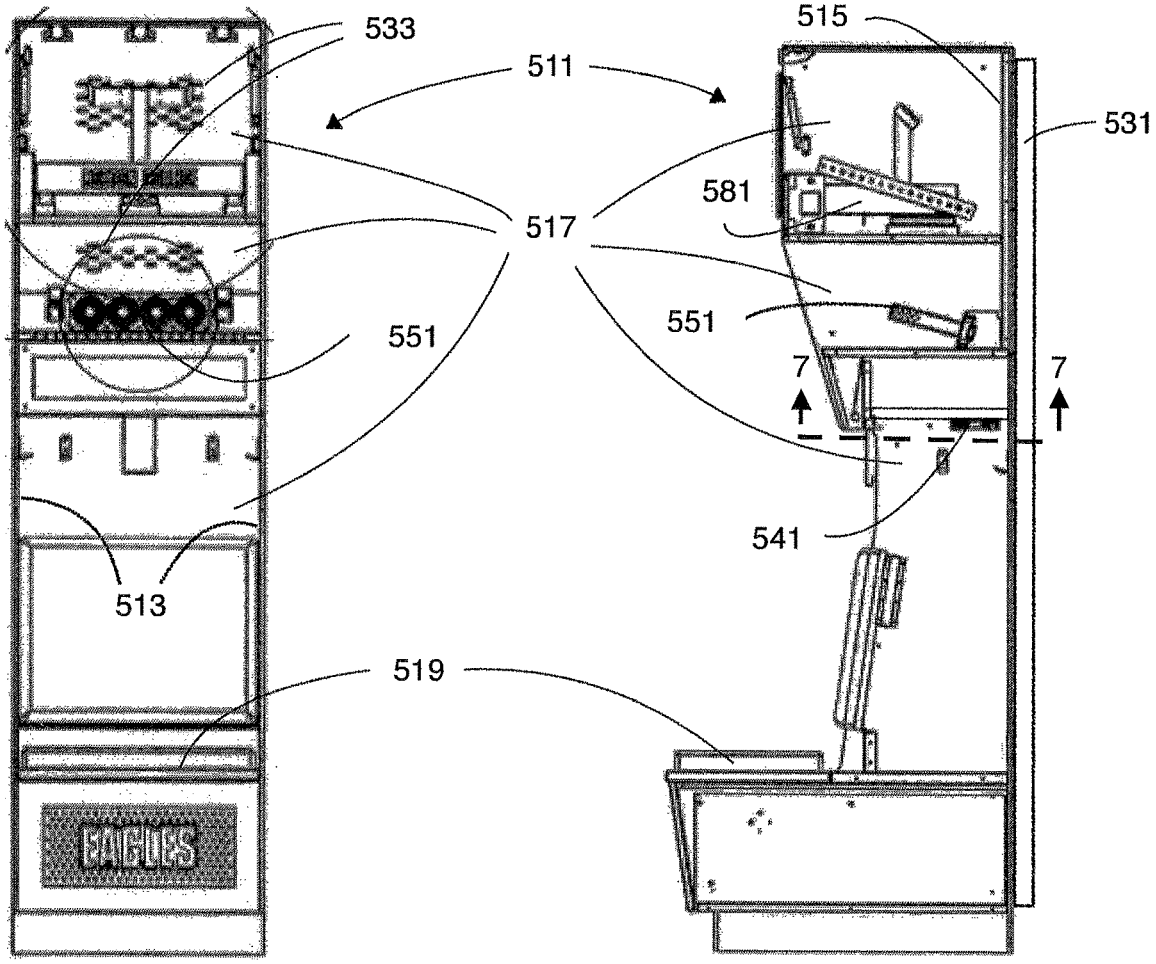
FIGS. 5A and 5B are front and side elevation views of another embodiment of a locker according to the present application.
Figure 6:
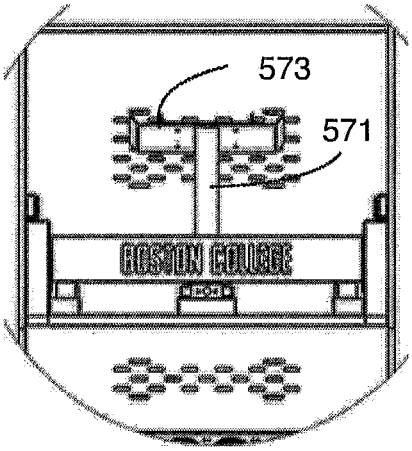
FIGS. 6 and 7 are enlarged elevation views of portions of the locker of FIGS. 5A and 5B.

FIGS. 5A and 5B are elevation and side views of a locker 511 similar in many respects to those described above, but further adapted for storage of extremely wet equipment for sports such as hockey. One aspect of locker 511 is that it is constructed entirely of solid phenolic core panel material (available from Wilsonart LLC 2501 Wilsonart Drive, P.O. Box 6110 Temple, Tex. 76503-6110) and stainless steel. The panel material is mostly polymeric (rather than fibrous or cellulosic, as in the case of wood and wood products) and resembles wood or wood laminates but is water-resistant and impervious to long-term exposure to moisture.

Locker 511 is generally similar to locker 111, with sidewalls 513, back wall 515, and shelves or horizontal surfaces defining compartments 517. A seat 519 may be provided. A plenum 531 may be carried on back wall 515 to connect to a pre-existing HVAC system to apply negative pressure (vacuum or suction) to the interior of locker 511 to remove or evacuate moisture-laden air. Ventilation grilles 533 may be provided in back wall 515 to draw in air from the exterior of locker 511, and may be provided with dampers or adjustable apertures, as described above.

Figure 7:
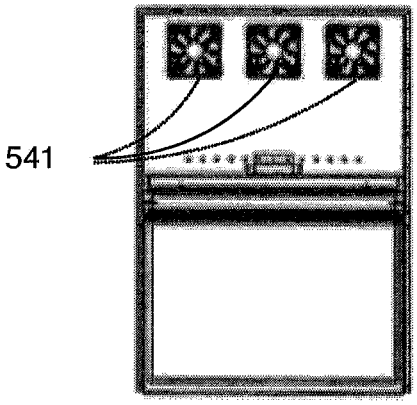

A plurality (three) of circulation fans 541, as described above, may be secured to the lower surface of a horizontal shelf with appropriate apertures (see FIG. 7) to promote air circulation within locker 511, between upper and lower compartments. A glove or equipment dryer 551, as described above, may be disposed in a medially located compartment 517.

A skate rack 571, 573, may be disposed in an uppermost compartment 517 of locker 511 for storage of ice or roller skates. Rack comprises a vertically extending member 571, with a horizontally extending member or cross bar 573 that provides a pair of horizontally extending projections on either side of vertical member 571 that may be received in the interior of a skate boot to support the skates while stored and drying. The skate rack 571, 573 may be carried on a pull-out drawer 581 that slides in and out of compartment 517 for ease of access.

It will be appreciated that the operation of lockers 111, 211, 511 may be automated. For example, in certain embodiments, the placement of items, such as skates, helmets, gloves, etc. within the various compartments of lockers 111,211, 511 could cause automatic activation of the ventilation systems. This automated process could be programmed to turn on the circulation fans for a predetermined amount of time after activation, or could be set to turn on the ventilation systems at predetermined times and/or days, such as on game days or after practice sessions. In addition, lockers 111, 211, 511 may include various sensors, such as moisture or odor sensors, such that the ventilation systems are automatically activated in response to signals from the sensors.

It is apparent that a locker system with significant advantages has been described and illustrated. The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description and claims. Although the present embodiments are shown above, they are not limited to just these embodiments, but are amenable to various changes and modifications without departing from the spirit thereof.

I claim:

1. An improved ventilated locker comprising:

a pair of sidewalls, each sidewall formed at least partially of water-resistant polymer material;

a back wall connecting the sidewalls, the back wall formed at least partially of water-resistant polymer material;

a plurality of compartments defined between the sidewalls, including at least an upper compartment and a lower compartment;

a plenum disposed adjacent the back wall, the plenum configured for connection to an existing HVAC system to apply negative pressure to at least the plurality of compartments of the locker;

an upper ventilation grille carried by the back wall in fluid communication with at least one of the plurality of compartments and with the plenum;

a lower ventilation grille carried by the back wall in fluid communication with at least one of the plurality of compartments and with the plenum; and at least one circulation fan disposed in one of the plurality of compartments to circulate air from the ventilation grilles through the plurality of compartments.

2. The improved ventilated locker of claim 1, further comprising:

a front wall carried between the sidewalls forward of the back wall, the front wall formed at least partially of water-resistant polymer material; and a front ventilation grille carried by the front wall.

3. The improved ventilated locker of claim 2, wherein the upper, lower, and front ventilation grilles include a damper mechanism to control airflow through the ventilation grilles.

4. The improved ventilated locker according to claim 1, wherein the at least one circulation fan includes an equipment drying fixture disposed in one of the plurality of compartments and carrying a circulation fan configured to supply air circulation to at least one item of equipment.

5. The improved ventilated locker according to claim 4, wherein the equipment drying fixture comprises:

a manifold carrying at least one circulation fan; and a pair of projections extending from the manifold, each projection configured to receive and support an item of equipment.

6. The improved ventilated locker according to claim 5, wherein each projection includes a circulation fan in a perforated housing.

7. The improved ventilated locker according to claim 5, wherein the manifold is in fluid communication with the plenum.

8. An improved ventilated locker comprising:

a pair of sidewalls, each sidewall formed at least partially of water-resistant polymer material;

a back wall connecting the sidewalls, the back wall formed at least partially of water-resistant polymer material;

a plurality of compartments defined between the sidewalls, including at least an upper compartment and a lower compartment;

a plenum disposed adjacent the back wall, the plenum configured for connection to an existing HVAC system;

at least one ventilation grille carried by the back wall in fluid communication with at least one of the plurality of compartments and with the plenum; and a skate rack configured to receive each of a pair of skates and support them.

9. The improved ventilated locker of claim 8, further comprising:

a front wall carried between the sidewalls forward of the back wall, the front wall formed at least partially of water-resistant polymer material; and a front ventilation grille carried by the front wall.

10. The improved ventilated locker of claim 8, wherein the at least one ventilation grille includes a damper mechanism to control airflow through the at least one ventilation grille.

11. The improved ventilated locker according to claim 8, further comprising an equipment drying fixture.

12. The improved ventilated locker according to claim 11, wherein the equipment drying fixture comprises:

a manifold carrying at least one circulation fan; and the pair of projections extend from the manifold.

13. The improved ventilated locker according to claim 12, wherein each projection includes a projection circulation fan in a perforated housing.

14. The improved ventilated locker according to claim 12, wherein the manifold is in fluid communication with the plenum.

15. The improved ventilated locker according to claim 8, further comprising:

a circulation fan disposed in one of the plurality of compartments.

16. The improved ventilated locker according to claim 8, further comprising an exhaust conduit coupled to the locker to exhaust air from the locker to a location remote from the locker.

17. The improved ventilated locker according to claim 8, wherein the skate rack comprises:

a vertical member having a lower end secured to a horizontally extending member and an upper end; and a horizontal member carried by the upper end of the vertical member and defining a projection on each side of the vertical member to receive and support each of a pair of skates.

18. An improved ventilated locker, comprising:

a pair of sidewalls, each sidewall formed at least partially of water-resistant polymer material;

a back wall connecting the sidewalls, the back wall formed at least partially of water-resistant polymer material;

a plurality of compartments defined between the sidewalls, including at least an upper compartment and a lower compartment;

at least one divider wall that divides at least one of the plurality of compartments;

a plenum disposed adjacent the back wall, the plenum configured for connection to an existing HVAC system duct;

a plurality of apertures through the back wall to permit fluid communication between the plenum and at least one of the plurality of compartments; and an aperture in the divider wall to permit fluid communication between compartments.

19. The improved ventilated locker according to claim 18, further comprising:

a front wall carried between the sidewalls forward of the back wall, the front wall formed at least partially of water-resistant polymer material; and an aperture in the front wall.

20. The improved ventilated locker according to claim 18, wherein at least one aperture is an opening for a ventilation grille.

21. The improved ventilated locker according to claim 20, wherein the ventilation grille includes a damper mechanism to control airflow through the ventilation grille.

22. The improved ventilated locker according to claim 18, further comprising:

at least one circulation fan disposed in at least one of the plurality of compartments.

23. The improved ventilated locker according to claim 19, wherein a lowermost compartment is defined between the front wall and the back wall, a divider wall divides the lowermost compartment into front and rear lowermost compartments, and an aperture is formed in the divider wall to permit fluid communication between the front and rear lowermost compartments.

24. The improved ventilated locker according to claim 19, wherein at least one of the apertures includes a ventilation grille.

* * * * *